US007976150B2

(12) United States Patent
Ueno

(10) Patent No.: US 7,976,150 B2
(45) Date of Patent: Jul. 12, 2011

(54) INKJET RECORDING APPARATUS

(75) Inventor: Kenichi Ueno, Hachioji (JP)

(73) Assignee: Konica Minolta Medical & Graphics, Inc., Tokyo (JP)

( * ) Notice: Subject to any disclaimer, the term of this patent is extended or adjusted under 35 U.S.C. 154(b) by 808 days.

(21) Appl. No.: 11/950,284

(22) Filed: Dec. 4, 2007

(65) Prior Publication Data

US 2008/0136858 A1 Jun. 12, 2008

(30) Foreign Application Priority Data

Dec. 7, 2006 (JP) ..... 2006-330426

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 2002/0101491 | A1 | 8/2002 | Ervin et al. | |
| 2002/0118541 | A1* | 8/2002 | Stowell et al. | 362/294 |
| 2005/0062822 | A1* | 3/2005 | Suzuki et al. | 347/102 |
| 2008/0019405 | A1* | 1/2008 | Kurita et al. | 372/35 |

FOREIGN PATENT DOCUMENTS

| | | |
|---|---|---|
| JP | 2001-36148 | 2/2001 |
| JP | 2004-237603 | 8/2004 |
| JP | 2005-254560 | 9/2005 |
| JP | 2006-19676 | 1/2006 |
| WO | WO 2005/068509 A1 | 7/2005 |

OTHER PUBLICATIONS

European Search Report dated Apr. 27, 2009.

* cited by examiner

*Primary Examiner* — Matthew Luu

*Assistant Examiner* — Rut Patel

(74) *Attorney, Agent, or Firm* — Finnegan, Henderson, Farabow, Garrett & Dunner, L.L.P.

(57) ABSTRACT

An inkjet recording apparatus, including a recording head having a nozzle array to eject photo-curable ink onto a recording medium, and a radiating device which is placed next to the recording head, and which radiates an ink-curing light onto the photo-curable ink ejected on the recording medium, wherein the radiating device includes a plurality of light source units which radiate photo-curable ink, and a plurality of flow channels which are mounted to intersect with the nozzle array, and in which cooling water is made to flow to cool the plurality of the light source units.

11 Claims, 6 Drawing Sheets

INKJET RECORDING APPARATUS

CROSS REFERENCE TO RELATED APPLICATION

This application is based on Japanese Patent Application No. 2006-330426 filed on Dec. 7, 2006 with the Japanese Patent Office, the entire content of which is hereby incorporated by reference.

FIELD OF THE INVENTION

The present invention relates to an inkjet recording apparatus.

BACKGROUND OF THE INVENTION

An inkjet recording apparatus is well-known in which ultraviolet rays are radiated onto ultraviolet curable ink which was ejected from recording heads onto recording media, so that the ultraviolet curable ink is cured on the recording media.

In Unexamined Japanese Patent Application Publication No. 2005-254560, an inkjet recording apparatus is disclosed in which a plurality of LEDs (which are light-emitting diodes) are aligned as ultraviolet ray radiating devices. The radiating device using the LED is superior to other radiating devices, such as a mercury lamp or a metal halide lamps with respect to miniaturization and response characteristics, which will be described below.

Concerning the miniaturization, a reflector is essential to effectively radiate the rays from the mercury lamp radiating device, while a reflector is not essential for the LED radiating device. Further, in the LED radiating device, LEDs can be aligned at high density.

Concerning the response characteristics, to wait until the amount of radiating rays become stable is essential for the mercury lamp radiating device, while the LED radiating device can be quickly turned on and off. Due to this, the LED radiating device can be used for an inkjet recording apparatus working as an on-demand apparatus.

Unexamined Japanese Patent Application Publication 2006-19676 discloses an inkjet recording apparatus employing a light source unit in which a heat-sink is provided on a semiconductor element, because in a semiconductor light emitting elements, such as the LED and a semiconductor laser, the heat release value is so great that deterioration of the semiconductor light emitting elements is significant. Cooling water is made to flow through the heat-sink to cool the semiconductor light emitting elements.

Further, Unexamined Japanese Patent Application Publication 2006-19676, discloses a light source device in which a plurality of the light source units are aligned to radiate high output light.

Still further, as shown in FIG. 10 of Unexamined Japanese Patent Application Publication 2006-19676, to align a plurality of the light source units, a flow channel is structured in which cooling water, which has passed through one light source unit, enters the next light source unit. Due to this structure, water, heated by an upstream light source unit, is supplied to a downstream light source unit.

The semiconductor light emitting elements have characteristics in which the temperature dependency of luminescence intensity is very great. Accordingly, when the temperature differs in the cooling water of the upstream and downstream light source units as described above, cooling water absorbs different amounts of heat from each unit, so that the temperature of each semiconductor light emitting element differs, which results in a differing amount of light emitted between from each semiconductor light emitting element.

If the light source device, including a plurality of said light source units, is applied onto the ultraviolet ray radiating device of Unexamined Japanese Patent Application Publication No. 2005-254560, the following problems will be generated.

For example, in a case that the light source device is moved to scan the recording media, perpendicular to an aligned direction of the plurality of light source units, since the luminescence intensity differs between the light source units, ink curing condition will differ on portions of the recording media which face different light source units. If said ink curing conditions differ, the glossiness of the cured ink differs, which results in an uneven image (being uneven glossiness) striated in the scanning direction.

SUMMARY OF THE INVENTION

The present invention has been achieved to overcome the above problem, so that an object of the present invention is to provide an inkjet recording apparatus in which, even when the aligned light emitting elements having temperature dependency are used to form a radiating device, unevenness of the generated images can be prevented.

The inkjet recording apparatus of the present invention, includes a recording head having a nozzle array to eject photo-curable ink onto a recording medium, and a radiating device which is placed next to the recording head, and which radiates an ink-curing light onto the photo-curable ink ejected on the recording medium, wherein the radiating device includes a plurality of light source units which radiate photo-curable ink, and a plurality of flow channels which are mounted perpendicular to the nozzle array, and in which cooling water is made to flow to cool the plurality of the light source units.

DETAILED DESCRIPTION OF THE INVENTION

The present invention will be detailed based on the embodiments described below, however the invention is not to be limited to the present embodiments.

Embodiment 1

Figure 1:
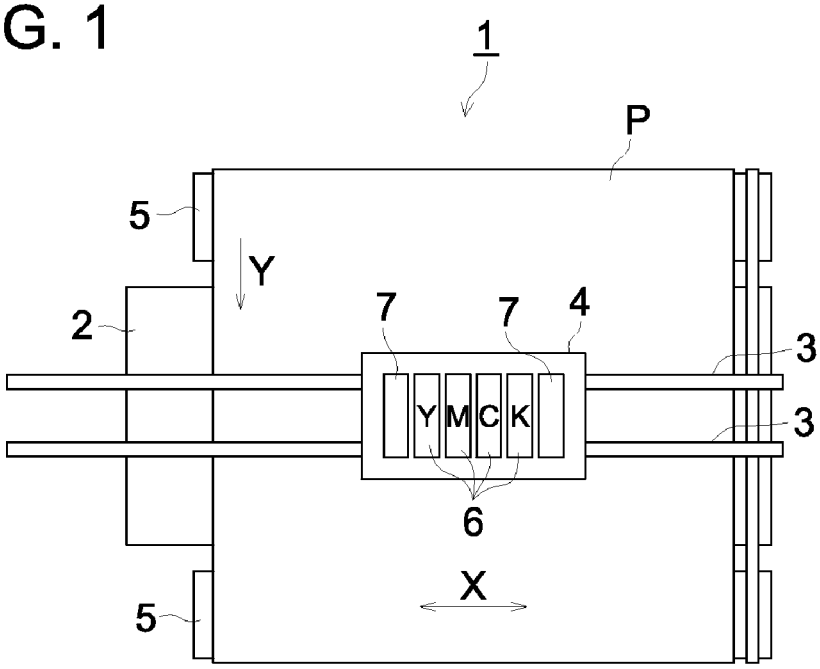
FIG. 1 is a schematic view of inkjet recording apparatus 1 relating to embodiment 1.

FIG. 1 is a schematic view of inkjet recording apparatus 1 relating to embodiment 1. Inkjet recording apparatus 1 relating to the present embodiment is a serial type inkjet recording apparatus. On inkjet recording apparatus 1, flat platen 2 is mounted to support recording medium P. Straight guide rails 3 are mounted along the longer direction of and above platen 2. Carriage 4, supported by guide rails 3, reciprocates in scanning direction X. Further, conveyance rollers 5 are mounted to convey recording medium P in conveyance direction Y, which is perpendicular to scanning direction X.

Recording heads 6 for four colors, yellow (Y), magenta (M), cyan (C) and black (K), are mounted on carriage 4. A plurality of ink jetting spouts (which are not illustrated) are mounted On each recording head 6 in a direction perpendicular to scanning direction X of carriage 4, to face recording medium P, and eject ink onto recording medium P.

Paired ultraviolet ray radiating devices 7 are mounted on both sides of carriage 4 to sandwich four recording heads 6. Ultraviolet ray radiating devices 7 radiate ultraviolet rays to cure the photo-curable ink ejected onto recording medium P.

The ink used in the present invention is an ultraviolet curable ink which is cured by the energy of the ultraviolet rays.

Recording medium P includes various paper, such as normal paper, recycled paper, and glossy paper, various woven fabrics, various non-woven fabrics, and other appropriate materials, such as resin, metal, and glass. The form of recording medium P includes rolled-up materials, cut-sheet materials and plate materials.

Figure 2:
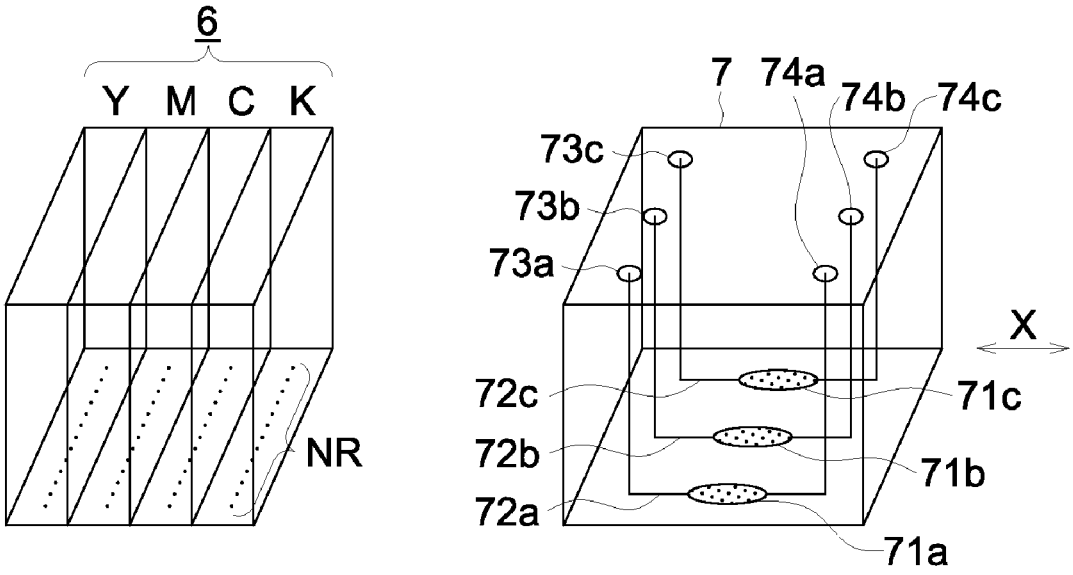
FIG. 2 is a schematic view of ultraviolet ray radiating device 7 relating to embodiment 1.
Figure 6:
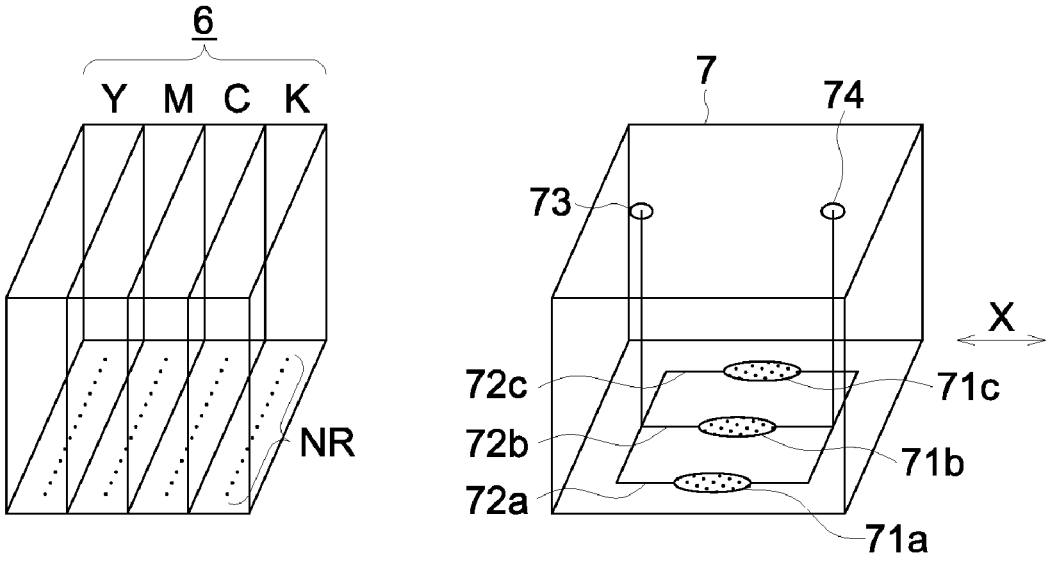
FIG. 6 is a schematic view of ultraviolet ray radiating device 7 relating to embodiment 4.

FIG. 2 is a schematic view of ultraviolet ray radiating device 7 relating to embodiment 1. Recording heads 6 are shown in FIG. 6. Only one of ultraviolet ray radiating devices 7 is illustrated in this figure. Scanning direction X of carriage 4 is also illustrated.

Ultraviolet ray radiating devices 7 incorporate a plurality of light source units 71*a*, 71*b* and 71*c*, which are aligned in the direction of nozzle array NR of head 6. The light source of light source units 71*a*, 71*b* and 71*c*, being a light source to radiate the ink-curing light to cure the photo-curable ink, is structured of a single or a plurality of the ultraviolet ray LEDs, being semiconductor photo emitting elements, to radiate ultraviolet rays. In FIG. 2, three light source units 71*a*, 71*b* and 71*c* are arranged. In order to obtain identical illuminance, the distances between recording medium P and each of light source units 71*a*, 71*b* and 71*c* must set to be equal.

Further, ultraviolet ray radiating device 7 incorporates flow channels 72*a*, 72*b*, and 72*c* through which cooling water is made to flow to light source units 71*a*, 71*b*, and 71*c*. Flow channels 72*a*, 72*b*, and 72*c* are mounted perpendicular to the direction of nozzle array NR of recording head 6, that is, mounted parallel to scanning direction X of carriage 4. In FIG. 2, flow channels 72*a*, 72*b* and 72*c* are mounted adjacent to light source units 71*a*, 71*b* and 71*c*, respectively. For the sake of simplicity, flow channels 72*a*, 72*b* and 72*c* are in contact with light source units 71*a*, 71*b* and 71*c*, respectively in FIG. 2. However, flow channels 72*a*, 72*b* and 72*c* are actually mounted near light source units 71*a*, 71*b* and 71*c*, respectively. Cross sectional areas of flow channels 72*a*, 72*b* and 72*c* are preferably formed to be equal. Further, ultraviolet ray radiating device 7 incorporates water supplying water supplying inlets 73*a*, 73*b* and 73*c*, to each of which the cooling water is supplied by a pump, which is not illustrated, and water outlets 74*a*, 74*b* and 74*c* from which the cooling water is ejected, corresponding to flow channels 72*a*, 72*b* 72*c*. The amount of cooling water to be supplied to each of flow channels 72*a*, 72*b* and 72*c* in a unit time is preferably set to be equal. The temperature of the cooling water supplied to each of flow channels 72*a*, 72*b* and 72*c* by the pump is also preferably set to be equal.

The cooling water supplied to each of water supplying inlets 73*a*, 73*b* and 73*c* flows through flow channels 72*a*, 73*b* and 72*c*, being adjacent to light source units 71*a*, 71*b* and 71*c*, so that the cooling water draws away the heat from light source units 71*a*, 71*b* and 71*c*, and is ejected from water outlets 74*a*, 74*b* and 74*c*.

In the case of the present embodiment, since the cooling water is supplied to each of light source units 71*a*, 71*b* and 71*c* through water supplying inlets 73*a*, 73*b* and 73*c*, respectively, the temperature of the cooling water to cool each of light source units 71*a*, 71*b* and 71*c* is approximately equal. Due to this, the amount of heat to be drawn from each of light source units 71*a*, 71*b* and 71*c* is equal, so that the temperature of each of light source units 71*a*, 71*b* and 71*c* remains equal. Accordingly, though light source units 71*a*, 71*b* and 71*c* exhibit the temperature dependency of the light emitting intensity, the light emitting intensity is controlled to be equal in each light source unit. That is, the degree of curing of the ink ejected onto recording medium P is prevented from differing between the portions of recording medium P, facing each light source unit. Accordingly, uneven images striated perpendicular to nozzle array NR (which are uneven images striated in the scanning direction of carriage 4) are prevented from being generated.

In the present embodiment, light source units 71*a*, 71*b* and 71*c* are aligned parallel to nozzle array NR of recording head 6, however, the direction of alignment is not limited to be parallel to nozzle array NR. That is, in FIG. 3 as the variation of embodiment 1, light source units 71*a*, 71*b* and 71*c* are shifted so that they can be aligned perpendicular to nozzle array NR of recording head 6 (which are aligned in scanning direction X of carriage 4). In this case, the water to cool light source units 71*a*, 71*b* and 71*c* exhibits the same temperature, whereby uneven images striated perpendicular to the direction of nozzle array NR (which are uneven images striated in the scanning direction of carriage 4) are prevented from being generated.

Embodiment 2

The inkjet recording apparatus of the present embodiment is structured in the same way as inkjet recording apparatus 1 of embodiment 1 so that any redundant explanation is omitted.

Figure 4:
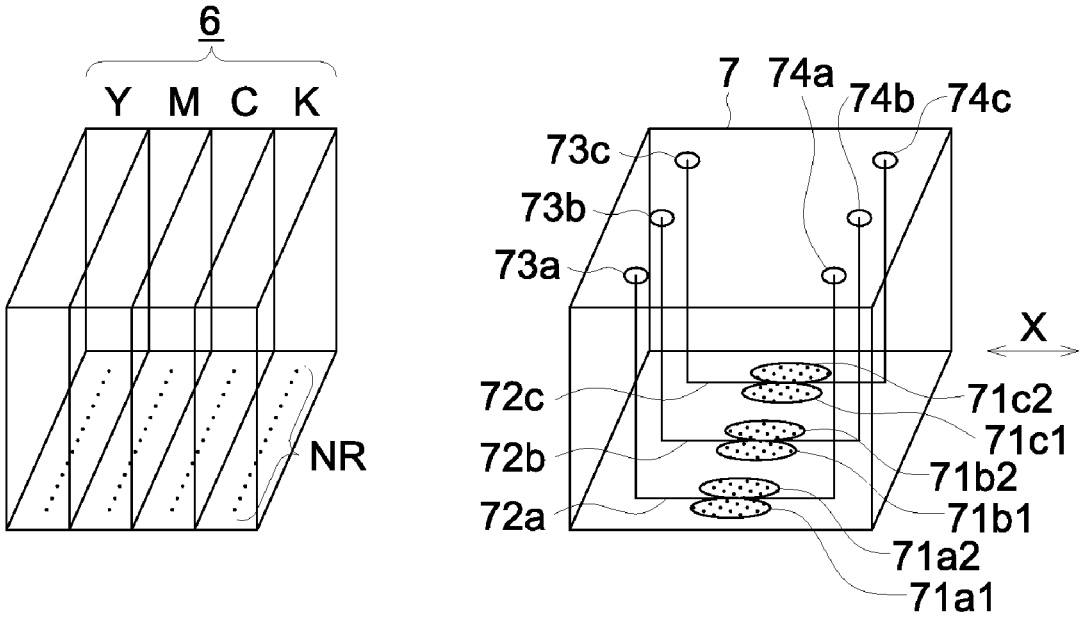
FIG. 4 is a schematic view of ultraviolet ray radiating device 7 relating to embodiment 2.

FIG. 4 is a schematic view of inkjet ultraviolet ray radiating device 7 relating to embodiment 2. The present embodiment includes the sane structure as embodiment 1, other than that plural light source units 71 are mounted parallel to nozzle array NR of recording head 6, while being arranged near a single flow channel.

In FIG. 4, light source units 71*a*1 and 71*a*2 are arranged parallel to the direction of nozzle array NR of recording head 6, with respect to flow channel 72*a*.

Light source units 71*b*1 and 71*b*2 are arranged parallel to the direction of nozzle array NR of recording head 6, with respect to flow channel 72*b*.

Light source units 71c1 and 71c2 are arranged parallel to the direction of nozzle array NR of recording head 6, with respect to flow channel 72c.

That is, with respect to each flow channel 72, two light source units 71 are arranged parallel to nozzle array NR of recording head 6. Hereinafter, for convenience sake, "light source unit group 71a" means paired light source units 71a1 and 71a2, "light source unit group 71b" means paired light source units 71b1 and 71b2, and "light source unit group 71c" means paired light source units 71c1 and 71c2.

In the same way as embodiment 1, in the present embodiment, the cooling water is supplied to light source unit group 71a (being 71a1 and 71a2), light source unit group 71b (being 71b1 and 71b2), and light source unit group 71c (being 71c1 and 71c2), through water supplying inlets 73a, 73b and 73c, respectively. Accordingly, the temperature of the cooling water to cool each of light source unit groups 71a, 71b and 71c is preferably approximately equal. Since each of light source unit groups 71a, 71b and 71c is structured of two light source units, the amount of water to be sent to each of light source units preferably remains equal. Due to this, the amount of heat drawn from each of light source units 71a1, 71a2, 71b1, 71b2, 71c1, and 71c2 is equal to each other, so that the temperature of each of light source units 71a1, 71a2, 71b1, 71b2, 71c1 and 71c2 remains equal. Accordingly, thought light source units 71a1, 71a2, 71b1, 71b2, 71c1 and 71c2 exhibit temperature dependency of the light emitting intensity, the light emitting intensity is controlled to be equal for each light source unit. That is, the degree of curing of the ink ejected onto recording medium P is prevented from differing between the portions of recording medium P facing each light source unit. Accordingly, uneven images striated perpendicular to the direction of nozzle array NR (which are uneven images striated in scanning direction X of carriage 4) are prevented from being generated. Further, based on the present embodiment, a plurality of light source units 73 are provided on a single flow channel 72, large light emitting amounts can be supplied onto recording sheet P.

Figure 3:
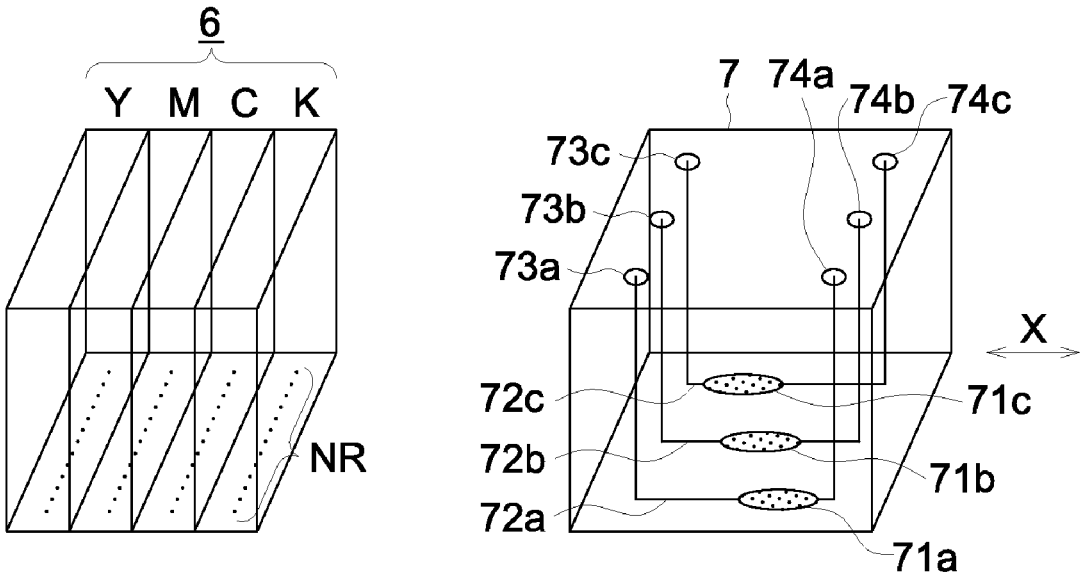
FIG. 3 is a variation of ultraviolet ray radiating device 7 relating to embodiment 1.

That is, in the same way as the variation of embodiment 1 in FIG. 3, light source units 71a (being 71a1 and 71a2,), 71b (being 71b1 and 71b2), and 71c (being 71c1 and 71c2) are shifted so that they can be aligned perpendicular to nozzle array NR of recording head 6 (that is, they are aligned in scanning direction X of carriage 4).

Embodiment 3

The inkjet recording apparatus of the present embodiment is structured in the same way as inkjet recording apparatus 1 of embodiment 1 so that any redundant explanation is omitted.

Figure 5:
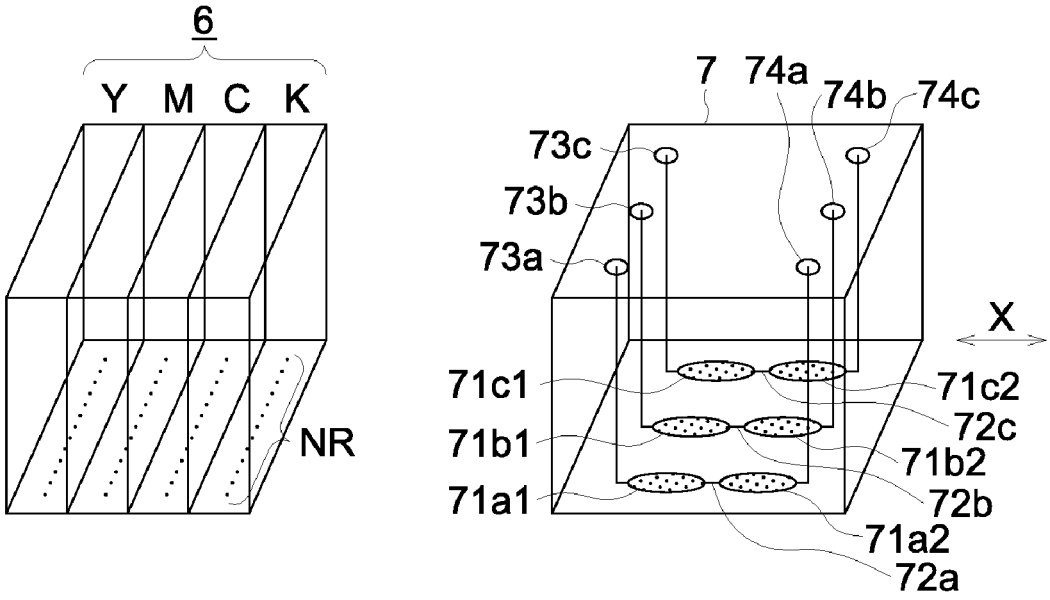
FIG. 5 is a schematic view of ultraviolet ray radiating device 7 relating to embodiment 3.

FIG. 5 is a schematic view of inkjet ultraviolet ray radiating device 7 relating to embodiment 3. The present embodiment includes the same structure as embodiment 1, other than that plural light source units 71 are mounted along a single nozzle array, (which is in scanning direction X of carriage 4).

In FIG. 5, light source units 71a1 and 71a2 are arranged along to flow channel 71a. Light source units 71b1 and 71b2 are arranged along flow channel 71b. Light source units 71c1 and 71c2 are arranged along the flow channel 72c. That is, two light source units 71 are arranged along each flow channel 72. Hereinafter, for convenience sake, "light source unit group 71a" means paired light source units 71a1 and 71a2, "light source unit group 71b" means paired light source units 71b1 and 71b2, and "light source unit group 71c" means paired light source units 71c1 and 71c2.

In the same way as in embodiment 1, in the present embodiment, the cooling water is supplied to light source unit group 71a (being 71a1 and 71a2), light source unit group 71b (being 71b1 and 71b2), and light source unit group 71c (being 71c1 and 71c2), through water supplying inlets 73a, 73b and 73c, respectively. The cooling water, which was supplied through water supplying inlets 73a, 73b and 73c, cools light source units 71a1, 71b1 and 71c1. Due to this structure, the temperature of the cooling water for cooling each light source 71a1, 71b1 and 71c1 unit is identical.

The cooling water, which has already been used to cool light source units 71a1, 71b1 and 71c1 and has been warmed to approximately the same heat level, is sent to cool light source units 71a2, 71b2 and 71c2 which are arranged downstream of each of light source units 71a1, 71b1 and 71c1. That is, though the temperature of said cooling water is slightly higher than the cooling water which is supplied from water supplying inlets 73a, 73b, and 73c, said temperature is identical. Accordingly the cooling water is still enough to reduce the temperature of light source units 71a2, 71b2 and 71c2.

In result, light source units 71a1, 71b1 and 71c1 radiate equal luminescence intensity compared to each other. Light source units 71a2, 71b2 and 71c2 radiate light luminescence intensity which is different from light intensity from light source units 71a1, 71b1 and 71c1, but radiates equal light luminescence intensity.

Ultraviolet ray radiating device 7 radiates ultraviolet rays onto recording sheet P, while carriage 4 moves in scanning direction X. Focusing attention on ink ejected onto recording medium P, said ink faces a line of the light sources which are aligned along scanning direction X of carriage 4. For example, the ink deposited on recording medium P facing light source unit 71a1 also faces light source 71a2 which is aligned along scanning direction X of recording medium P. As a result, summation of ultraviolet rays from light source units 71a1 and 71a2 are radiated onto the ink ejected onto recording medium P. In the same way, the ink deposited on recording medium P facing light source unit 71b1 also faces light source 71b2, whereby summation of ultraviolet rays from light source unit 71b1 and 71b2 are radiated onto the ink ejected onto recording medium P. Further, the ink deposited on recording medium P facing light source unit 71c1 also faces light source 71c2, whereby summation of ultraviolet rays from light source unit 71c1 and 71c2 are radiated onto the ink ejected onto recording medium P.

As detailed above, each of the light luminescence intensities of light source units 71a1, 71b1 and 71c1 is equal, and each of the light luminescence intensities of light source units 71a2, 71b2 and 71c2 is also equal. Accordingly, [the light radiating amounts of light source units 71a1 and 71a2], [the light radiating amounts of light source units 71b1 and 71b2] and [the light radiating amounts of light source units 71c1 and 71c2] are equal.

Accordingly, though light source units 71a1, 71a2, 71b1, 71b2, 71c1 and 71c2 exhibit the temperature dependency of the light emitting intensity, the light emitting intensity is controlled to be equal in each of six light source units. That is, the degree of curing of the ink ejected onto recording medium P is prevented from differing among the portions of recording medium P facing each light source unit. Accordingly, uneven images striated perpendicular to the direction of nozzle array NR (which are uneven images striated in scanning direction X of carriage 4) are prevented from being generated. Further, based on the present embodiment, a plurality of light source units 73 are provided on a single flow channel 72, whereby large amount of emitted light can be supplied onto recording sheet P.

Embodiment 4

The inkjet recording apparatus of the present embodiment is structured in the same way as inkjet recording apparatus 1 of embodiment 1 so that any redundant explanation is omitted.

FIG. 6 is a schematic view of inkjet ultraviolet ray radiating device 7 relating to embodiment 4. The present embodiment includes the same structure as embodiment 1, other than that single water supplying inlet 73 and single water outlet 74 are mounted, and a flow channel from water supplying inlet 73 is divided into three channels to form flow channels (72*a*, 72*b* and 72*c*), after which the three flow channels are recombined to be a single flow channel to form water outlet 74.

Based on the present invention, as detailed in the case of embodiment 1, uneven image striated perpendicular to the direction of nozzle array NR (which is uneven image striated in scanning direction X of carriage 4) is prevented from being generated. Further, the number of water supplying inlets 73 and water outlets 74 can be decreased, so that ultraviolet ray radiating device can be downsized.

Embodiment 5

The inkjet recording apparatus of the present embodiment is structured in the same way as inkjet recording apparatus 1 of embodiment 1 so that any redundant explanation is omitted.

Figure 7:
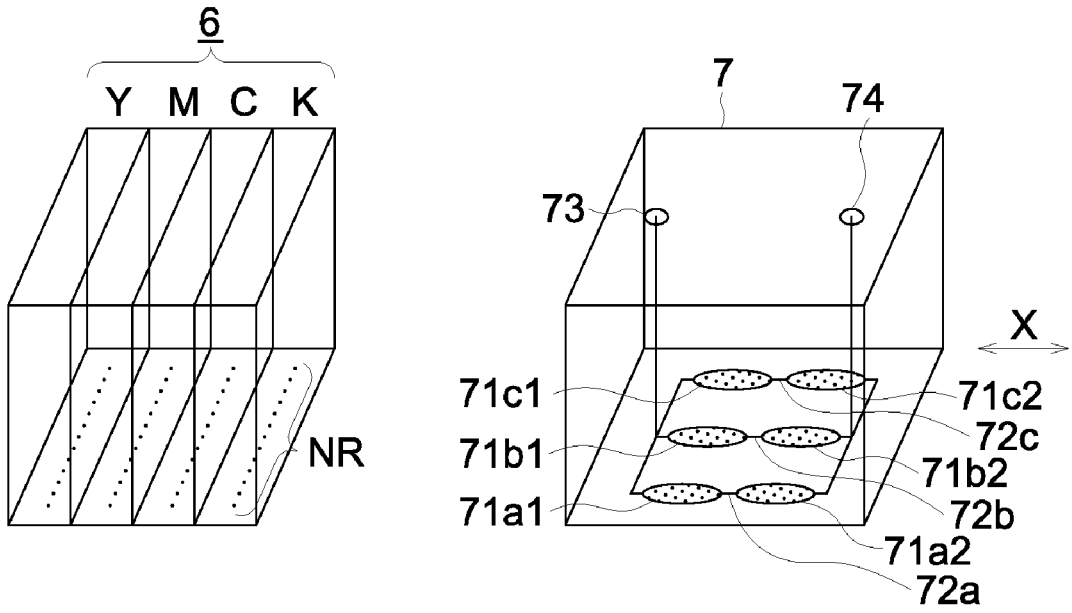
FIG. 7 is a schematic view of ultraviolet ray radiating device 7 relating to embodiment 5.

FIG. 7 is a schematic view of ultraviolet ray radiating device 7 relating to embodiment 5. The present embodiment includes the same structure as embodiment 3 in FIG. 5, other than that single water supplying inlet 73 and single water outlet 74 are mounted, and a flow channel from water supplying inlet 73 is divided into three channels to form flow channels 72*a*, 72*b* and 72*c*, after which said three flow channels are re-combined to be a single flow channel to form water outlet 74.

Based on the present invention, as detailed in the case of embodiment 1, uneven image striated perpendicular to the direction of nozzle array NR (which is uneven image striated in scanning direction X of carriage 4) is prevented from being generated. Further, since a plurality of light source units 73 are provided for single flow channel 72, a large amount of ultraviolet rays can be radiated. Still further, the number of water supplying inlets 73 and water outlets 74 can be reduced, which results in downsizing of ultraviolet ray radiating device 7.

Embodiment 6

The inkjet recording apparatus of the present embodiment is structured in the same way as inkjet recording apparatus 1 of embodiment 1 so that any redundant explanation is omitted.

Figure 8:
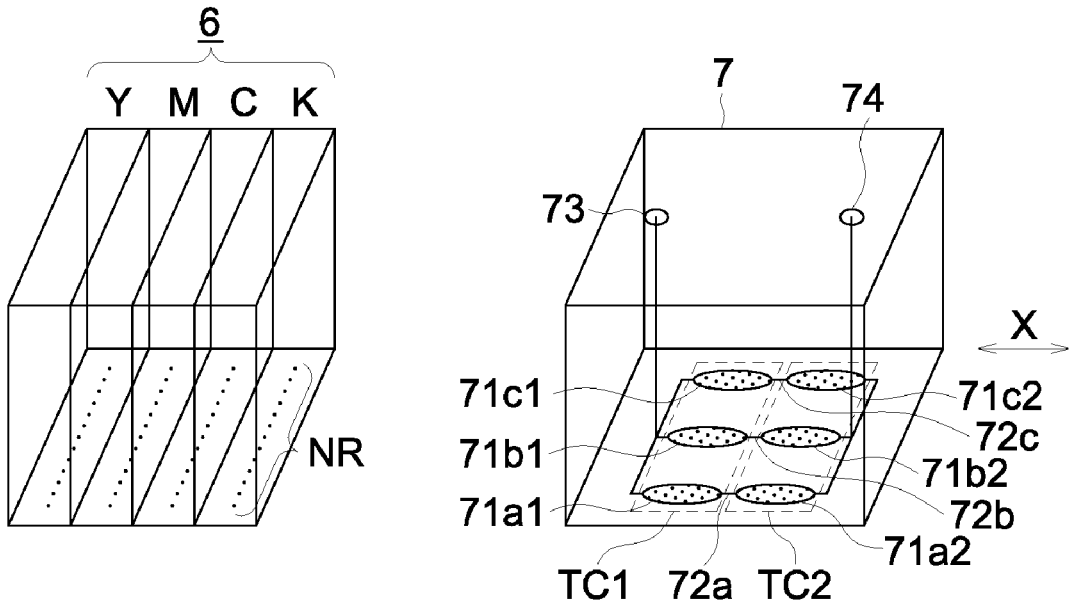
FIG. 8 is a schematic view of ultraviolet ray radiating device 7 relating to embodiment 6.

FIG. 8 is a schematic view of ultraviolet ray radiating device 7 relating to embodiment 6. The present embodiment includes the same structure as embodiment 5 in FIG. 5, other than that thermal conductive member TC1 is provided on which light source units 71*a*1, 71*b*1 and 71*c*1 are mounted in an integrated manner, as well as thermal conductive member TC2 is provided on which light source units 71*a*2, 71*b*2 and 71*c*2 are mounted in an integrated manner.

Since light source units 71*a*1, 71*b*1 and 71*c*1 are mounted on thermal conductive member TC1, which exhibits high heat conductivity, light source units 71*a*1, 71*b*1 and 71*c*1 tend to transfer heat among each other so that they are in a balanced heat state. Due to this, even though light source units 71*a*1, 71*b*1 and 71*c*1 are in different heat states, their temperatures become equal That is, their different light emitting intensities become equal. The same heat transferring procedure as the above also occurs in light source units 71*a*2, 71*b*2 and 71*c*2. Subsequently, uneven image striated in scanning direction X of carriage 4 are prevented from being generated.

Figure 9:
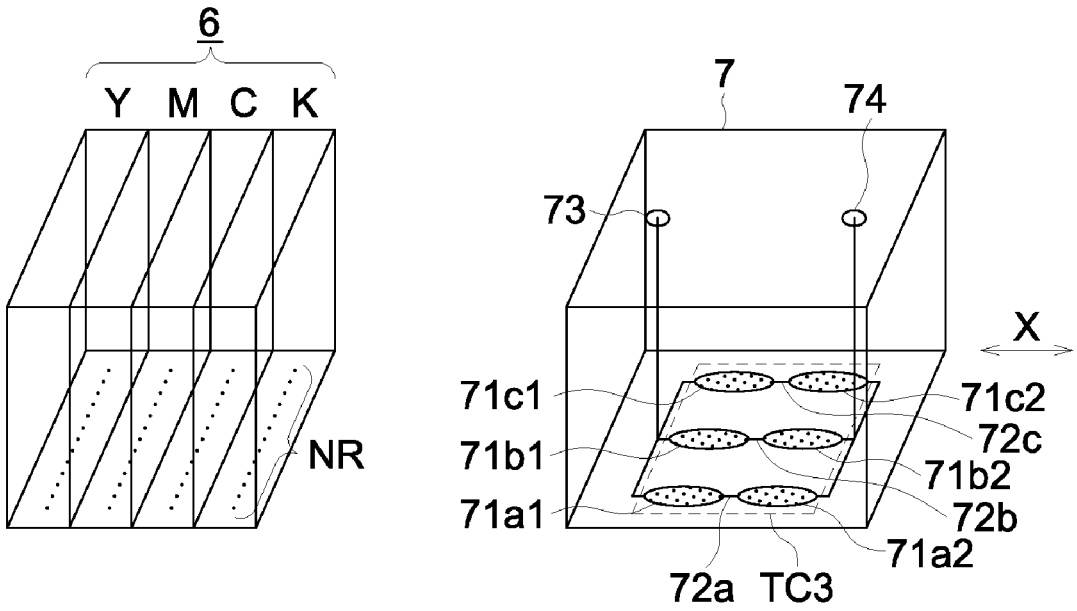
FIG. 9 is a variation of ultraviolet ray radiating device 7 relating to embodiment 6.

In the present embodiment, light source units 71*a*1, 71*b*1, 71*c*1, and light source units 71*a*2, 71*b*2, 71*c*2 are mounted on the individual thermal conductive members, but it is also possible to structure them on common thermal conductive member TC3 as shown in FIG. 9. In this structure, light source units 71*a*1, 71*b*1, 71*c*1, 71*a*2, 71*b*2 and 71*c*2 are totally controlled to be of the same temperature.

Concerning the heat transfer material, various materials are listed, such as aluminum, copper and iron, each of which exhibit high heat conductivity, specifically, aluminum is preferable, because of its ease of cutting.

Figure 10:
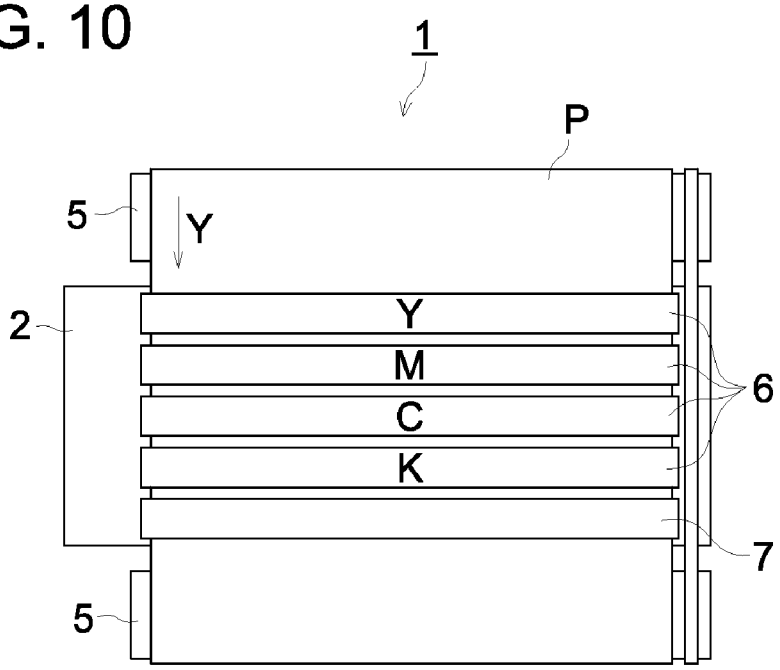
FIG. 10 is a schematic view of inkjet recording apparatus 1 relating to embodiment 7.

FIG. 10 is a schematic view of inkjet recording apparatus 1 relating to embodiment 7. Inkjet recording apparatus 1 of the present embodiment is a linear type inkjet recording apparatus. The same number designation is applied to members having the same functions as the members of inkjet recording apparatus 1 relating to embodiment 1 shown in FIG. 1.

On inkjet recording apparatus 2, flat platen 2 is mounted to support recording medium P. Recording medium P, placed on platen 2, is conveyed in conveyance direction Y by conveyance rollers 5. Recording heads 6, being yellow (Y), magenta (M), cyan (C) and black (K), in that order, from upstream of conveyance direction Y of recording medium P, are mounted across the width of recording medium P. A plurality of inkjetting nozzles (which are not illustrated) are aligned perpendicular to conveyance direction Y of recording medium P, on a surface of each recording head 6 facing recording medium P, to eject ink onto recording medium P.

Ultraviolet ray radiating device 7 is provided across the width of the recording medium P, downstream of tour recording heads 6 above platen 2.

Figure 11:
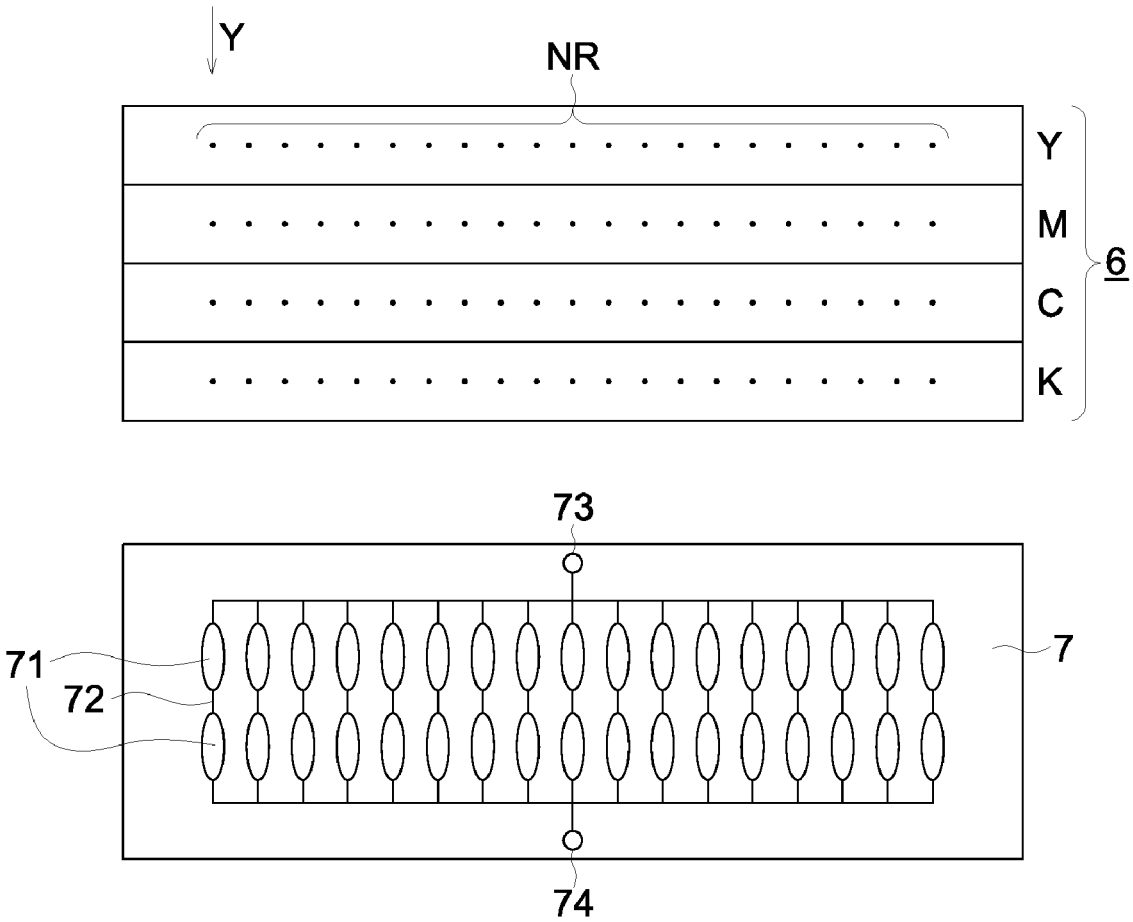
FIG. 11 is a schematic view of ultraviolet ray radiating device 7 relating to embodiment 7.

The structure of the present embodiment is the same as ultraviolet radiating device 7 of embodiment 5, other than that the linear type inkjet recording apparatus is employed. The schematic view of ultraviolet ray radiating device 7 relating to embodiment 7 is shown in FIG. 11.

On ultraviolet ray radiating device 7, a plurality of flow channels 72 are mounted perpendicular to alignment direction of nozzle array NR of linear type recording head 6, (being mounted along conveyance direction Y of recording medium P), and two light source units 71 are mounted along each flow channel 72. Single water supplying inlet 73 and single water outlet 74 are provided so that the cooling water entering water supplying inlet 73 is supplied to a plurality of flow channels 72, after which they re-combine to flow together to water outlet 74.

Based on the same idea as the case of embodiment 5, the total radiating amount of the two light source units on each flow channel 72 becomes equal.

Accordingly, though each light source unit 71 exhibits temperature dependency of the light emitting intensity, curing of the ink ejected on recording medium P is controlled to be the same. Accordingly, uneven image striated perpendicular to the direction of nozzle array NR of linear type recording head 6 (which are in conveyance direction Y of recording medium P) is prevented from being generated. Further, two light source units 73 are provided for each flow channel 72 in the present embodiment, so that a larger radiated amount of ultraviolet rays can be obtained.

In this embodiment, flow channels 72 are provided perpendicular to the alignment direction of nozzles array NR of linear type recording head 6, which is a preferable structure. At least, flow channels 72 may be structured so as to cross the alignment direction of nozzle array NR of recording head 6.

In the above embodiments, the LED is used as the light source exhibiting temperature dependency of luminescence intensity. However, these embodiments can be applied to cases in which various semiconductor light sources, such as EL (being electro-luminescence) elements and laser diodes, are to be used as the light source.

Further, in the present embodiments, the radiating device to radiate the ultraviolet rays is used, but the invention is not limited to this, since the wavelength of the light rays is no object, as long as it can adequately cure the ink.

Based on the present invention, in order to cool a plurality of light source units, a plurality of flow channels to control the flow of the cooling water are provided to cross the alignment direction of the nozzle arrays of the recording heads, so that even when the radiating elements exhibiting the temperature dependency are used for the radiating device, the radiating intensity of each light source unit, aligned in the nozzle array direction, can be controlled to remain within almost the same level. Due to this structure, different degrees of curing of the ink is prevented among the portions of recording medium P facing each light source unit, and uneven image striated in the scanning direction is prevented from being generated.

What is claimed is:

1. An inkjet recording apparatus, comprising:

a recording head including a nozzle array for ejecting photo-curable ink onto a recording medium; and a radiating device placed next to the recording head for radiating an ink-curing light onto the photo-curable ink ejected on the recording medium, wherein the radiating device includes:

a plurality of light source units which radiate the ink-curing light for curing the photo-curable ink; and a plurality of flow channels mounted perpendicular to the nozzle array in which cooling water is made to flow for cooling the plurality of light source units.

2. The inkjet recording apparatus of claim 1, wherein each of the plurality of light source units is arranged for each of the plurality of flow channels, respectively, and at least an equal number of light source units is provided for each of the plurality of flow channels.

3. The inkjet recording apparatus of claim 2, wherein the number of the light source units for each of the plurality of flow channels is two or more, and the plurality of light source units are arranged parallel to the nozzle array.

4. The inkjet recording apparatus of claim 2, wherein each of the light source units is arranged along parallel to each of the flow channels.

5. The inkjet recording apparatus of claim 1, further comprising:

a water supplying inlet for supplying cooling water into the plurality of flow channels, wherein a flow channel from the water supplying inlet is divided into a plurality of flow channels.

6. The inkjet recording apparatus of claim 5, further comprising:

a water outlet which re-combines the plurality of flow channels and ejects the cooling water flown from the plurality of flow channels.

7. The inkjet recording apparatus of claim 1, further comprising:

a thermal conductive member on which the plurality of light source units are mounted parallel to the nozzle array in an integrated manner.

8. The inkjet recording apparatus of claim 7, wherein the thermal conductive member is arranged along the plurality of flow channels, and wherein the light source units along the plurality of flow channels are mounted on the thermal conductive member.

9. The inkjet recording apparatus of claim 1, wherein each light source unit includes a semiconductor element as a light emitting element.

10. The inkjet recording apparatus of claim 1, wherein each light source unit includes a light emitting diode as the light emitting element.

11. The inkjet recording apparatus of claim 1, wherein the ink-curing light includes ultra violet rays.

* * * * *